US008584672B2

(12) United States Patent
Walts

(10) Patent No.: US 8,584,672 B2
(45) Date of Patent: Nov. 19, 2013

(54) PROTECTIVE HOOD

(75) Inventor: William Shane Walts, Indian Trail, NC (US)

(73) Assignee: Scott Technologies, Inc., Boca Raton, FL (US)

( * ) Notice: Subject to any disclaimer, the term of this patent is extended or adjusted under 35 U.S.C. 154(b) by 1660 days.

(21) Appl. No.: 11/350,225

(22) Filed: Feb. 8, 2006

(65) Prior Publication Data

US 2011/0023873 A1 Feb. 3, 2011

(51) Int. Cl.
*A62B 17/00* (2006.01)
*A62B 18/00* (2006.01)

(52) U.S. Cl.
USPC ..... 128/201.22; 128/201.23; 128/201.24; 128/201.29; 128/206.21; 128/207.11; 2/202; 2/422

(58) Field of Classification Search
USPC ..... 128/201.22, 201.23, 201.24, 201.29, 128/201.17, 201.19, 205.25, 206.12, 128/206.16, 206.21, 206.23, 206.24, 128/206.27, 206.28, 207.11; 2/202, 422
See application file for complete search history.

(56) References Cited

U.S. PATENT DOCUMENTS

| | | | | | |
|---|---|---|---|---|---|
| 4,504,536 | A * | 3/1985 | Wong | 428/151 |
| 4,727,628 | A * | 3/1988 | Rudholm | 24/170 |
| 4,811,728 | A * | 3/1989 | Von Kopp | 128/201.25 |
| 4,987,653 | A * | 1/1991 | Lin | 24/68 CD |
| 5,140,980 | A * | 8/1992 | Haughey et al. | 128/201.25 |
| 5,630,412 | A * | 5/1997 | Dubruille et al. | 128/206.23 |
| 6,338,342 | B1 * | 1/2002 | Fecteau et al. | 128/207.11 |
| 6,588,424 | B2 * | 7/2003 | Bardel | 128/207.11 |
| 6,701,925 | B1 * | 3/2004 | Resnick | 128/206.17 |
| 6,931,668 | B2 * | 8/2005 | Dobbie et al. | 2/422 |
| 2004/0089302 | A1 * | 5/2004 | Foss | 128/204.18 |
| 2004/0144481 | A1 * | 7/2004 | Poulos et al. | 156/230 |
| 2005/0246868 | A1 * | 11/2005 | Garofalo et al. | 24/170 |

* cited by examiner

*Primary Examiner* — Clinton T Ostrup
(74) *Attorney, Agent, or Firm* — Wyatt B. Pratt

(57) ABSTRACT

In accordance with an embodiment of the present invention, a protective hood is provided for protecting a wearer's head and face from environmental elements. The hood includes a hood body, a lens, a nose cup disposed inside of the hood body and harness assembly. The harness assembly is attached to the outside of the hood body for securing the hood body and nose cup to the wearer's head and face. The hood further includes at least one nose cup link. Each nose cup link having a portion that is internal to the hood body, a portion that is external to the hood body and a mid-section portion that is connected to the hood body at a plurality of points along mid-section portion. The harness assembly is connected to the external portion of the hood cup link for adjusting the nose cup.

36 Claims, 4 Drawing Sheets

PROTECTIVE HOOD

BACKGROUND OF THE PRESENT INVENTION

The present invention relates generally to a hood for protecting a wearer against hazardous environmental elements, and in particular to a protective hood utilizing a unique harness assembly with a nose cup link for more securely fastening the protective hood and nose cup to the wearer's head and face.

Firefighters, rescue workers, civilians and others working in chemical, biological and nuclear laboratories, and any other environments, are often in need of protective hoods to protect their faces and heads from chemical, biological, radiological, or nuclear contaminants that may be present in the air around them. The protective hoods can be donned by the individuals for use in escaping their hazardous environment. A protective hood typically includes a protective head covering, a lens and/or face plate, and a nose cup or mask that is capable of being attached to an air filter and/or respirator. Protective hoods may be worn alone or in combination with a full body suit, and may be formed from various materials. However, in any event, it is desirable that the protective hood be securely donned on the wearer's head, and the nose cup be securely fastened against the wearer's face, so as to prevent dangerous environmental elements from penetrating the protective hood and the nose cup and putting the wearer at risk.

While there are various known designs for protective hoods that utilize a strap and/or harness to secure the nose cup to the face, none of these designs effectively utilize a harness disposed externally on the outside of the head covering for adjusting an internally disposed nose cup. For example, European Patent EP0054 154 discloses a breath protection hood for emergency evacuations. The breath protection hood comprises a helmet with a wide neck opening, an external adjustable strap system, a face window, and an internal mask situated beneath the helmet. The external adjustable strap is fixedly attached (e.g., with a rivet) at a point of attachment to a securing flange that is formed in the unit with the sides of the inner mask. Consequently, when the ends of the straps are pulled, a force is exerted on the point of attachment pulling the hood and internal mask closer to the face. The neck opening is not tightened by the force, but rather remains in its original position.

Unfortunately, this design is not optimal since it is possible for hazardous environmental elements to penetrate the breath protection hood either at the point of attachment, if the force at the point of attachment is significant enough to cause the inner mask and hood to separate at the point of attachment, or through the wide neck opening. Further, the external adjustable strap system is not routed through any channels and/or guides at the rear of the wearer's head. Consequently, the adjustable strap system may unintentionally slide up and down the wearer's head, potentially allowing the protective hood to slip off the wearer's head. In addition, the adjustable strap system is designed to pass through a ring or other similar device near the wearer's ears. When the adjustable strap system is pulled to tighten the breath protection hood about the wearer's head, the rings or other devices may press against the wearer's ears causing discomfort for the wearer. Finally, European Patent EP0054 154 discloses a protective hood with a large nose cup. This nose cup may or may not pass the applicable $CO_2$ standards because of its size, since a large nose cup may allow more $CO_2$ to enter the nose cup than is acceptable. Although the nose cup of European Patent EP0054 154 could potentially be replaced with a smaller nose cup that would be more likely to pass $CO_2$ standards, if such a change were made, an excessive amount of hood material would be left in the nose cup area. This excess material could impact the wearer's ability to effectively tighten the nose cup and protective hood about the wearer's head and face.

Thus, it would be desirable to have a protective hood with an external harness that fits securely about the wearer's head and is linked to the nose cup by a tab having an external end that is attached to the harness, a mid-section that is attached to the head covering and an internal end that is attached to the nose cup, whereby when a force is exerted on the ends of the harness, an equal and opposite force is exerted on the external portion of the tab pulling the nose cup more securely against the wearer's face and tightening the head covering around the wearer's head, without compromising the wearer's safety. The material-to-material bond of the tabs of this design provides reinforcement at the point where the force is being applied to adjust the nose cup. This desirable design also takes into account possible excess material in the area of the tab as a result of elongation of the head covering under hot, cold and ambient temperatures and ensures that the excess material does not interfere with the force being translated to the tab and, ultimately, the nose cup.

In addition, an external harness is more desirable because it is easier to don and provides better protection for the wearer. Once an internal harness system has been donned and the wearer has been exposed to hazardous environmental elements, the wearer can not easily adjust the internal harness system without exposing the wearer directly to the hazardous environmental elements. Thus, internal harness systems are typically made from elastic material and are "one size fits all." Unfortunately, wearer's are not all one size. Even for average-size wearers, internal harness systems may be difficult to don in cold temperatures, whereas in warm temperatures, they may loosen to the point where the nose cup is no longer securely fastened about the wearer's face. Thus, an external harness system that can be easily adjusted at any time is desirable.

Further, there exist various mechanisms for fitting a harness about a head covering or directly on a wearer's head. However, there are no existing protective hoods that fit the harness about the head using upper rear and lower rear retention elements and front side lacing elements (i.e., in close proximity to the nose cup) such that when the harness is routed through the retention and lacing elements, the harness is disposed on the sides of the hood body in a Z-shape. These retention and lacing elements act as guides for the harness, thereby preventing any unintentional up and down movement of the harness. This design is desirable because when a force is placed on the ends of the harness to tighten the harness, the force is equally balanced on both sides of the hood because of the symmetrical lacing of the harness. Further, when a force is exerted on the ends of the harness, this design allows for an equal and opposite force to be translated to the nose cup at the lacing elements located at the front sides of the head covering, thereby pulling the nose cup more securely against the wearer's face without damaging the head covering. Thus, it would be desirable to have a protective hood with such a lacing mechanism.

Likewise, there does not exist a protective hood with a harness that forms a "free-floating" loop on the rear of the head covering where the harness is allowed to freely move within the lacing elements, thereby allowing a wearer to tighten the harness without placing any tension on the material of the head covering other than the tension that is placed on the tab connected to the nose cup. A feature of this type would prevent the head covering from being stretched, torn, or otherwise damaged. Thus, it would be desirable to have a protective hood with a harness that forms a "free-floating" loop on the rear of the head covering.

Finally, there does not exist a protective hood with a harness that uses a double locking mechanism formed from two friction lock elements that are connected via a second, separate piece of harness or, alternatively, two buckles connected together with a hinge. A double locking mechanism of the foregoing type disposed at the lower, rear of the head covering would be beneficial in imposing a frictional force on the harness to prevent the harness from sliding without an external force being exerted directly on the harness. In addition, a double locking mechanism would provide the additional frictional engagement necessary to secure devices of greater weights to the front of the hood at the nose cup. Thus, it would be beneficial to have a protective hood with a double locking mechanism.

Until now, there has not been a protective hood that provides any of the desirable features discussed above, individually or in combination thereof. Such a device would ensure the safety of the wearer and allow the wearer to attach a respirator or other air device of greater weight to the front of the hood.

SUMMARY OF THE PRESENT INVENTION

In accordance with an embodiment of the present invention, a protective hood is provided for protecting a wearer's head and face from environmental elements. The hood includes a hood body, a lens, a nose cup disposed inside of the hood body and harness assembly. The harness assembly is attached to the outside of the hood body for securing the hood body and nose cup to the wearer's head and face. The hood further includes at least one nose cup link. Each nose cup link having a portion that is internal to the hood body, a portion that is external to the hood body and a mid-section portion that is connected to the hood body at a plurality of points along the mid-section portion. The harness assembly is connected to the external portion of the hood cup link for adjusting the nose cup.

In accordance with an alternative embodiment, a protective hood is provided that includes a hood body, a lens, a nose cup and harness assembly. The harness assembly is attached to the outside of the hood body for securing the hood body and nose cup to the wearer's face. The harness assembly includes a harness having first and second ends and an upper retention element disposed on the upper rear portion of the hood body. The harness assembly further includes a front lacing element externally attached to the hood body near the nose cup and lower retention element disposed on a lower rear portion of the hood body. The harness is routed from the upper retention element through the front lacing element and through the lower retention element. The harness is disposed along the sides of the hood body in a generally Z-shape forming a rearward projecting angle at the front lacing element and forward projecting angle at the lower retention element.

BRIEF DESCRIPTION OF THE DRAWINGS

Further features, embodiments, and advantages of the present invention will become apparent from the following detailed description with reference to the drawings.

DETAILED DESCRIPTION OF THE PREFERRED EMBODIMENTS

Figure 1:
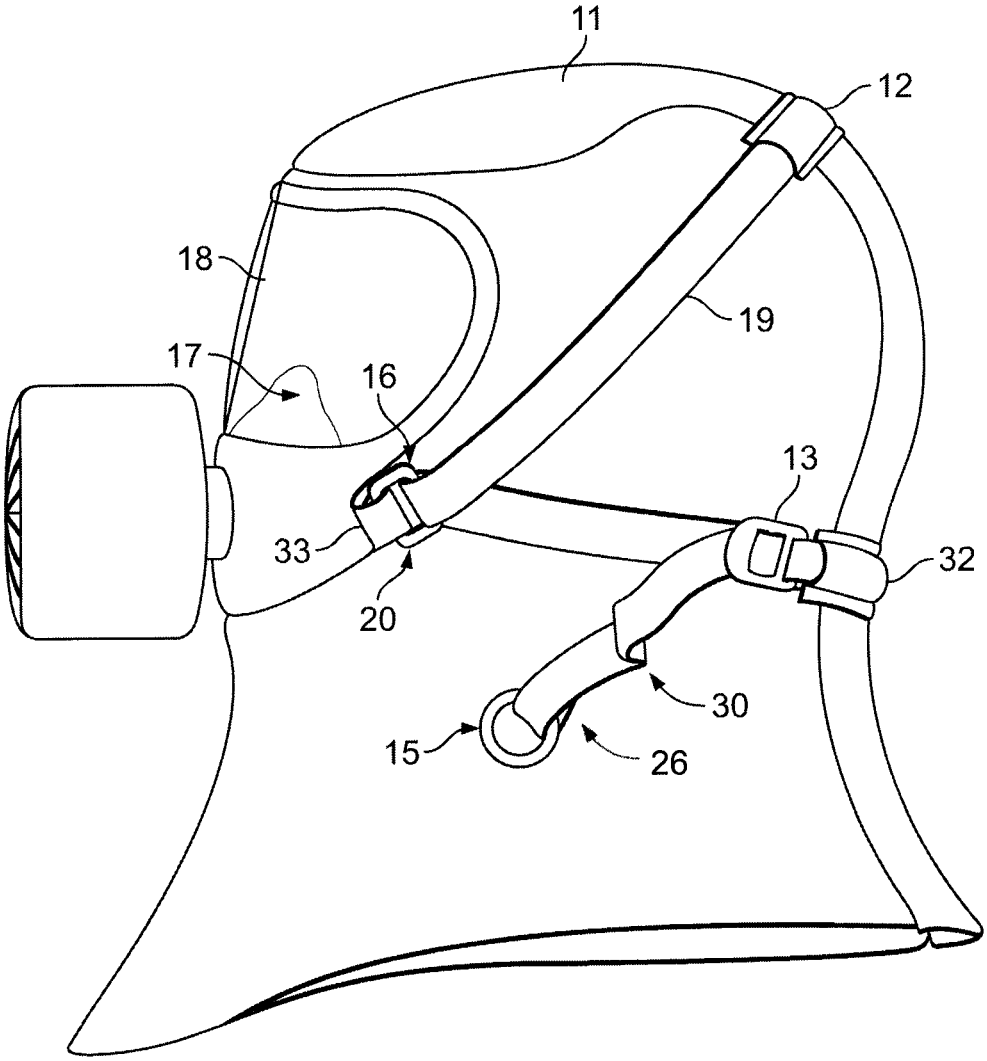
FIG. 1 is a side view of a protective hood assembly in accordance with the preferred embodiments of the present invention.

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

Figure 2:
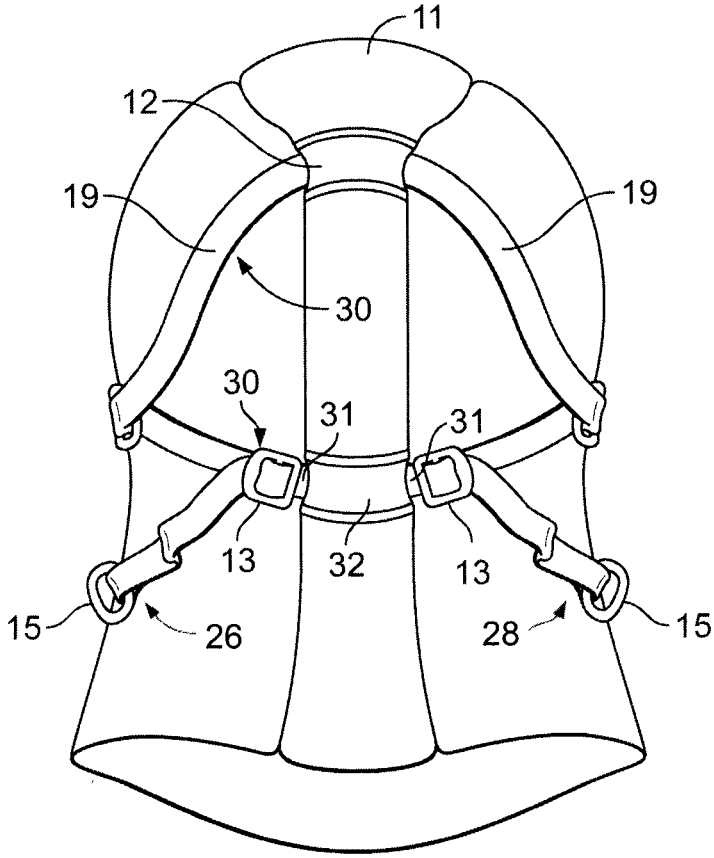
FIG. 2 is a back view of the protective hood assembly of FIG. 1.

FIGS. 1 and 2 are a side view and a back view, respectively, of a protective hood assembly 10 in accordance with the preferred embodiments of the present invention. As illustrated in FIG. 1, the protective hood assembly 10 includes a hood body 11, a lens or face piece 18, a nose cup 17 disposed inside the hood body 11, and a harness assembly 30. In the preferred embodiment, the hood body is made from a laminate consisting of four (4) layers of material that are bonded together using a process such as RF welding or heat sealing, or a material such as an epoxy. The two (2) outermost layers are made from a PVC material, while the two (2) inner most layers are made from a proprietary material, such as the proprietary material available from the manufacturer ISCO. Alternatively, if the protective hood assembly 10 is to be used as a smoke escape, the hood body 11 can be formed from any self-extinguishing or flame retardant material that can be bonded in the manner described above. The nose cup 17 may be of conventional design and typically includes an inlet 24 for receiving breathable air from a reliable source in a conventional manner. The lens or face piece 18 may be formed from the same PVC laminate as the hood body 11 or from a pure PVC sheet, urethane material or polycarbonate.

The harness assembly 30 includes one or more sections 19, 31 of harness, a set of retention elements 12, 32 and D-rings 16 to guide the harness sections 19, 31, a plurality of friction locks 13 for the harness 19, and a pair of finger rings 15 for pulling on ends 26, 28 of the harness 19. The harness sections 19, 31 are preferably flexible, durable and resistant to the various hazards present in the environments in which the hood assembly 10 is intended to be used. As described and illustrated, the harness sections 19, 31 comprise a web-type strap material, but it will be apparent that other constructions, such as rope or the like, may likewise be used without departing from the scope of the present invention, provided that appropriate modifications or substitutions are made to the other components of the harness assembly 30. Possible materials for the manufacture of the harness assembly 30 include nylon, polyester, Kevlar®, and Nomex®. Alternatively, if the protective hood assembly 10 is to be used as a smoke hood, the harness assembly 30 may be manufactured from a flame retardant material such as Nomex®, Kevlar®, or other similar material.

The set of retention elements includes an upper retention element 12 and a lower retention element 32. The retention elements may be formed from the same PVC laminate as the hood body 11. However, the retention elements could also be formed from any material that is capable of being heat sealed or RF welded. Each external D-ring 16 is connected by a tab or loop 20 to the exterior surface of the hood body 11 at a point generally proximate the nose cup 17 for a purpose that will become evident herein below. The tab 20 may be made of the same material as the hood body 11 and connected thereto by heat sealing, RF welding, or material to material bonding with an epoxy.

In the illustrated embodiment, a first harness strap 19, having a finger ring 15 disposed at each end 26, 28 thereof, is routed through, and centered in, the upper retention element 12, and the two opposing ends 26, 28 of the harness 19 are routed or laced symmetrically through the D-rings 16 and the friction locks 13 as shown in FIG. 1. In other words, beginning at the upper retention element 12, one half of the harness 19 is first routed around the upper side of the hood body 11 to a respective D-ring 16, through which the harness 19 may freely pass. This routing of the harness 19 from the upper side of the hood body 11 to the respective D-ring 16 prevents the harness 19 from being depressed against the wearer's ears, potentially causing discomfort to the wearer. From the D-ring 16, the harness 19 is routed around the side of the hood body 11 to a respective friction lock 13, which when used as intended prevents the harness from sliding back and forth therein unless subjected to sufficient force to overcome the frictional effect imposed thereby. Finally, when the harness is routed through the friction lock 13, the harness hangs in a forward manner towards the lower side of the hood body 11. Each end 26, 28 of the harness terminates at a respective finger ring 15. Advantageously, the lacing scheme for the illustrated embodiment allows for the least amount of bunching of the hood body 11 when a force is exerted on the harness 19 to tighten the hood body 11 on the wearer's head.

As perhaps best illustrated in FIG. 2, the friction locks 13 are affixed to a separate harness section 31 that passes through the lower retention element 32, which resides in the back of the hood body 11 at the base of the wearer's head. This second harness section 31 is allowed to slide freely in the lower retention element 32, thereby balancing the load imposed by the first harness section 19 on the friction locks 13 from one side of the wearer's head to the other.

Figure 3:
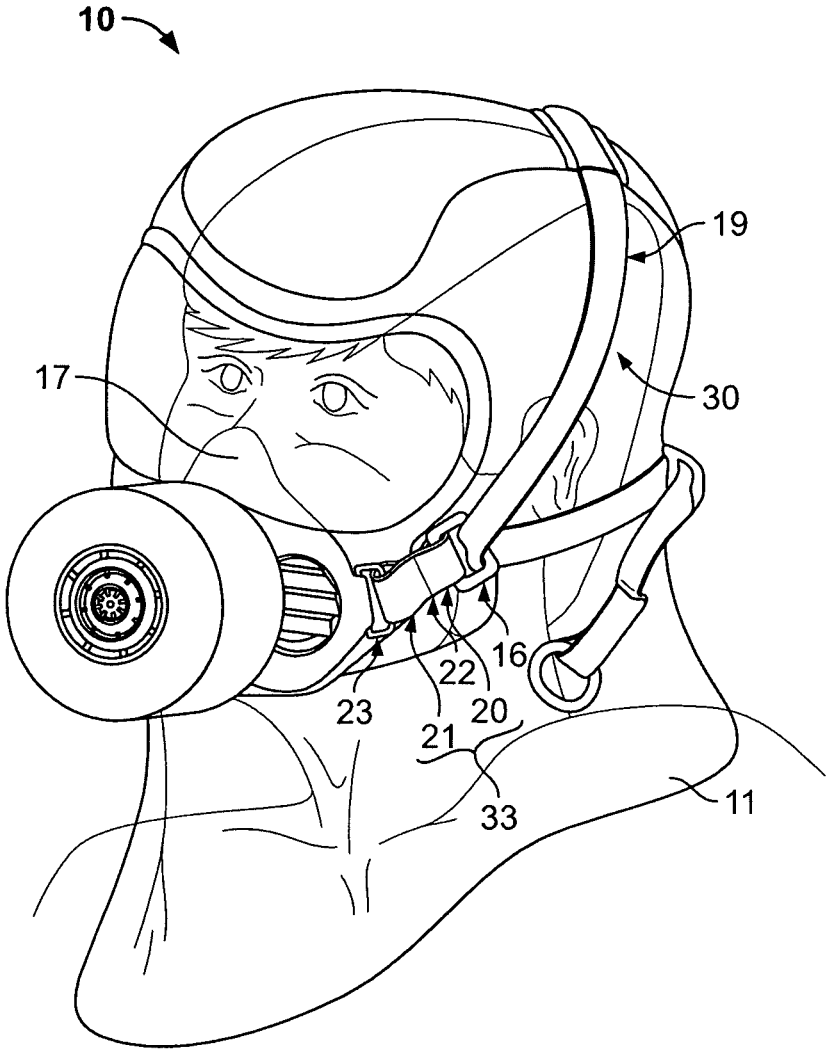
FIG. 3 is a perspective view of the protective hood assembly of FIGS. 1 and 2, illustrating the connection of the nose cup to the hood.
Figure 4:
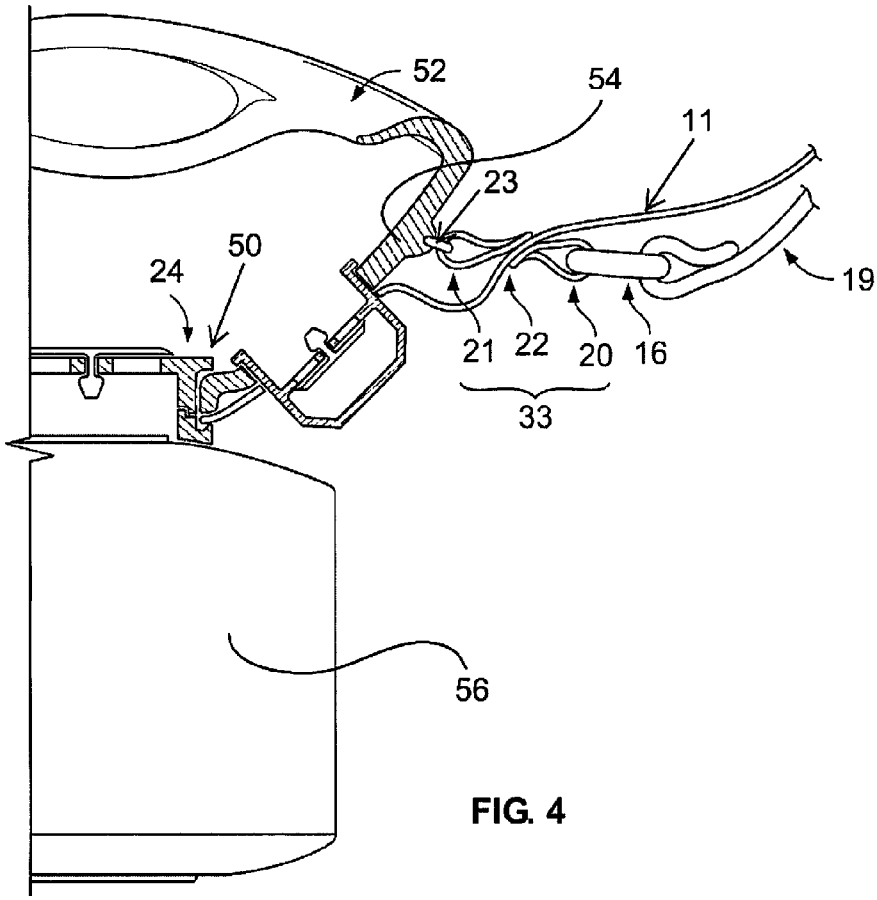
FIG. 4 is an enlarged view of a portion of the protective hood assembly of FIG. 3.

FIG. 3 is a perspective view of the protective hood assembly 10 of FIGS. 1 and 2, illustrating the connection of the nose cup 17 to the hood body 11, while FIG. 4 is an enlarged view of a portion of the protective hood assembly 10 of FIG. 3. As illustrated in FIGS. 3 and 4, an additional, internal D-ring 23 may be disposed on each side of the nose cup 17, beneath or on the interior of the hood body 11. It will be apparent, however, that a feature similar to a D-ring may alternatively be incorporated directly into the body of the nose cup 17 itself. As best seen in FIG. 4, the nose cup 17 includes a filter reception area 50 that includes the inlet 24, a rear portion 52 that fits against the wearer's face, and sidewalls 54 that extend from the filter reception area 50 to the rear portion 52. The D-rings 23, or the equivalents thereof, are disposed on the sidewalls 54 adjacent the rear portion 50 of the nose cup 17. Each internal D-ring 23, or the equivalent thereof, is connected by an internal tab or loop 21 to the interior surface of the hood body 11 at a point immediately adjacent the connection of the corresponding external tab 20 to the hood body 11, all for a purpose that will become evident herein below. As previously discussed, the tab may be made of the same material as the hood body 11 and connected thereto by heat sealing, RF welding, or material to material bonding with an epoxy. Together, the respective connections of the external and internal tabs 20, 21 create a shared joint on each side of the hood body 11.

By connecting the internal nose cup D-rings 23 and the external harness D rings 16 to the same shared joint 22 on the hood body 11, a pair of nose cup links 33 are thus created, providing a direct connection between the harness assembly 30 (via the external D-rings 16 and external tabs 20) and the nose cup 17 (via the internal D-rings 23 and the internal tabs 21). One portion of each nose cup link 33 resides on the outside of the hood body (i.e., the portion closest to the harness D-ring 16), while the other portion of the link 33 resides beneath the hood body 11.

The length of each internal tab 21 is selected to be of relatively minimal length, such that if the shared joint area 22 were to be pulled away from the nose cup 17, the maximum displacement of the shared joint 22, relative to the nose cup 17, would be limited by stretching the tabs 21 to their maximum length rather than by stretching the hood body 11. Thus, forces placed on the external D-rings 16 by tension in the harness assembly 30, as described below, are thus translated directly to the nose cup 17 by the two nose cup links 33, rather than being transferred to the hood body 11.

In use, the hood body 11 is first donned by the wearer. It may be desirable to first loosen the harness assembly 30 by manipulating the friction locks 13 in a conventional manner in order to allow the main harness section 19 to slide therethrough. The wearer then places the hood body 11 over his head and pulls it downward while at the same time fitting the nose cup 17 over his nose and mouth. As shown in FIG. 1, when the protective hood assembly 10 is in use, the upper retention element 12 is thus positioned in the back of the hood body 11 near the top of the wearer's head. A breathing air source, such as an air purifying device, an SCBA, or the like, may be connected to the nose cup inlet 24 before, during or after this process, depending on the environment, the wearer's preference, and other factors. For example, FIG. 4 illustrates an air purifying filter 56 that is connected to the nose cup 17 at the filter reception area 50 in fluid communication with the inlet 24.

With the hood assembly 10 properly arranged on the wearer's head, the wearer may adjust the fit of the hood body 11 on his head and face by pulling on the finger rings 15 to adjust the relative tightness of the harness assembly 30. This action pulls a desired length of the first harness section 19 through the friction locks 13 and external D-rings 16, shortening the relative distances between the various lacing elements and causing the hood body 11 to fit more snugly on the wearer's head. Because at least some of the tension thus created is placed on the external D-rings 16, this method also has the effect of placing tension on the nose cup links 33. As described previously, rather than causing the hood body 11 to be stretched and perhaps torn or otherwise damaged, this tension is translated to the nose cup 17 and from there to the wearer's face.

Thus, not only does tightening the harness assembly 30 cause the hood body 11 to fit more snugly on the wearer's head, but it also causes the nose cup 17 to fit more snugly on the wearer's face. In fact, the relative pressure or force of the nose cup 17 on the wearer's face is opposed by the pressure or force of the harness assembly 30 on the back of the wearer's head in the areas of the upper and lower retention elements 12, 32.

Of perhaps equal importance, tightening the harness assembly 30 does not place any tension on the material of the hood body 11 other than that which is translated through the shared joints 22 to the nose cup 17 (which as described above may be kept minimal by controlling the length of the internal D-ring tabs 21 nose cup links 33 relative to the material of the hood body 11). This is achieved by the creation of a single free-floating loop of harness sections 19, 31 in the harness assembly 30 in which additional tension is opposed only by the loop itself, rather than by some portion of the hood body 11. At any time, this loop may be understood as including the two friction locks 13, the second harness section 31 (which connects the friction locks 13 together), and portion of the first harness section 19 extending from one friction lock 13 through a first external D-ring 16, through the upper retention element 12 and finally through the second external D-ring 16 to the other friction lock 13. Because the first harness section 19 is allowed to slide freely through the D-rings 16 and the upper retention element 12, while the second harness section 31 is allowed to slide freely through the lower retention element 32, little or no tension is placed on any portion of the hood body 11, during normal use, other than that placed on the shared joints 22 by the external D-ring tabs 20. This likewise helps prevent the hood body 11 from being stretched and perhaps torn or otherwise damaged.

Because pulling either finger ring 15 tends to tighten the single continuous loop of the harness assembly 30, it will be apparent that in an alternative embodiment, a single friction lock 13 or similar mechanism could be substituted, with only a single free harness end extending therefrom for the tightening the harness assembly 30. However, because the various lacing components inherently impose a frictional force on the harness sections 19, 31, such a design may make it difficult to provide uniform side-to-side balancing, thus creating some discomfort for the wearer.

Figure 5:
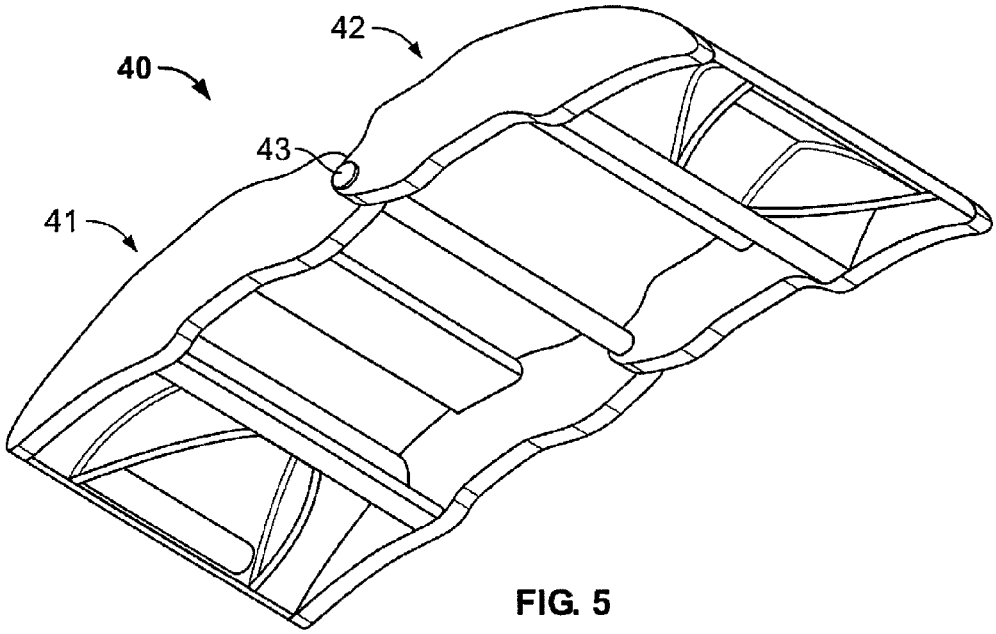
FIG. 5 is a perspective view of an alternative friction lock that may be used with the protective hood assembly of FIG. 1.

It will also be apparent that the function of the two friction locks 13, the second harness section 31 and the lower retention element 32 could be carried out by alternative means. For example, FIG. 5 is a perspective view of an alternative friction lock 40 that may be used with the protective hood assembly 10 of FIG. 1. This "double-locking" friction lock 40 includes two discrete friction lock elements 41, 42 connected by a hinge 43. Because the friction lock elements 41, 42 are connected to each other directly, no separate harness section 31 is necessary. As with the preferred embodiment, the alternative friction lock 40 creates a free-floating loop of harness 31 at the rear of the wearer's head that slides freely through the lower retention element 32, thereby placing little or no tension on the hood body 11, other than the tension that is placed on the shared joints 22 by the external D-ring tabs 20. Similarly, this alternative friction lock 40 when used in conjunction with the upper retention element 12 and first harness section 19 helps prevent the hood body 11 from being stretched and perhaps torn or otherwise damaged.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A protective hood for protecting a wearer's head and face from environmental elements comprising:

a hood body;

a lens;

a nose cup having a rear portion configured to fit against the wearer's face, the rear portion being disposed inside the hood body;

a harness assembly attached to the outside of the hood body for securing the hood body and nose cup to the wearer's head and face; and a nose cup link having an internal tab that is internal to the hood body and an external tab that is external to the hood body, the internal tab being connected at a coupling point to a side wall of the nose cup, the external tab being connected to the harness assembly at a coupling ring, wherein the internal and external tabs are joined to interior and exterior surfaces, respectively, of the hood body at connection points that are immediately adjacent each other to create a shared joint between the internal and external tabs.

2. A protective hood in accordance with claim 1, wherein the hood body is formed from a laminate.

3. A protective hood in accordance with claim 1, wherein the nose cup comprises a filter reception area, the sidewall of the nose cup extending from the filter reception area to the rear portion, the coupling point between the internal tab of the nose cup link and the sidewall of the nose cup being adjacent the rear portion of the nose cup.

4. A protective hood in accordance with claim 1, wherein the nose cup includes an inlet for receiving breathable air from an air source.

5. A protective hood in accordance with claim 1, wherein the internal tab of the nose cup link is bonded to the interior surface of the hood body and the external tab of the nose cup link is bonded to the exterior surface of the hood body.

6. A protective hood in accordance with claim 1, wherein the harness assembly is comprised of:

a harness having a first end and a second end, an upper retention element disposed on an upper, rear portion of the hood body, a front lacing element externally attached to the hood body near the nose cup, and a lower retention element disposed on a lower, rear portion of the hood body, wherein the harness is routed from the upper retention element through the front lacing element and then through the lower retention element.

7. A protective hood in accordance with claim 6, wherein the front lacing element is a D-ring.

8. A protective hood in accordance with claim 6, wherein the harness freely slides through the upper retention element, front lacing element and lower retention element thereby reducing the amount of tension that is placed on any portion of the hood body.

9. A protective hood in accordance with claim 1, wherein the harness comprises a pair of ends, a finger ring being attached to the ends of the harness for pulling the harness to adjust the relative tightness of the harness assembly and nose cup.

10. A protective hood in accordance with claim 1, wherein the nose cup comprises a filter reception area, the protective hood further comprising a filter connected to the nose cup at the filter reception area.

11. A protective hood in accordance with claim 1, wherein the internal tab of the nose cup link is connected to the nose cup only at the side wall.

12. A protective hood in accordance with claim 1, wherein the internal and external tabs of the nose cup link are joined to the hood body at ends of the internal and external tabs, the end of the internal tab being spaced apart from the end of the external tab by the hood body.

13. A protective hood in accordance with claim 1, wherein the internal and external tabs of the nose cup link do not penetrate the hood body.

14. A protective hood in accordance with claim 1, wherein the hood body extends between the internal and external tabs of the nose cup link.

15. A protective hood in accordance with claim 1, wherein the internal tab of the nose cup link comprises a loop.

16. A protective hood in accordance with claim 1, wherein the nose cup comprises a connection ring, the internal tab of the nose cup link comprising a loop that is connected to the connection ring.

17. A protective hood in accordance with claim 16, wherein the connection ring comprises a D-ring.

18. A protective hood in accordance with claim 1, wherein the coupling ring comprises a D-ring.

19. A protective hood in accordance with claim 1, wherein the internal and external tabs of the nose cup link are discrete components from each other and the hood body.

20. A protective hood in accordance with claim 1, wherein the shared joint between the internal and external tabs of the nose cup link translates tension in the harness assembly to the nose cup instead of the hood body.

21. A protective hood in accordance with claim 1, wherein the shared joint between the internal and external tabs of the nose cup link permits limited movement of the hood body relative to the side wall of the nose cup.

22. A protective hood for protecting a wearer's head and face from environmental elements comprising:

a hood body;

a lens;

a nose cup disposed inside the hood body;

a harness assembly attached to the outside of the hood body for securing the hood body and nose cup to the wearer's head and face; and a nose cup link having an internal tab that is internal to the hood body and an external tab that is external to the hood body, the internal tab being connected at a coupling point to a side wall of the nose cup, the external tab being connected to the harness assembly, wherein the internal and external tabs are bonded to interior and exterior surfaces, respectively, of the hood body at connection points that are immediately adjacent each other to create a shared joint between the internal and external tabs.

23. A protective hood in accordance with claim 22, wherein the hood body is formed from a laminate.

24. A protective hood in accordance with claim 22, wherein the nose cup comprises a filter reception area and a rear portion, the sidewall of the nose cup extending from the filter reception area to the rear portion, the coupling point between the internal tab of the nose cup link and the sidewall of the nose cup being adjacent the rear portion of the nose cup.

25. A protective hood in accordance with claim 22, wherein the nose cup includes an inlet for receiving breathable air from an air source.

26. A protective hood in accordance with claim 22, wherein the harness comprises a pair of ends, a finger ring being attached to the ends of the harness for pulling the harness to adjust the relative tightness of the harness assembly and nose cup.

27. A protective hood in accordance with claim 22, wherein the harness assembly is comprised of:

a harness having a first end and a second end, an upper retention element disposed on an upper, rear portion of the hood body, a front lacing element externally attached to the hood body near the nose cup, and a lower retention element disposed on a lower, rear portion of the hood body, wherein the harness is routed from the upper retention element through the front lacing element and then through the lower retention element.

28. A protective hood in accordance with claim 27, wherein the front lacing element is a D-ring.

29. A protective hood in accordance with claim 27, wherein the upper retention element, the lower retention element and the nose cup links are formed from the same material as the hood body.

30. A protective hood in accordance with claim 27, wherein the harness freely slides through the upper retention element, front lacing element and lower retention element thereby reducing the amount of tension that is placed on any portion of the hood body.

31. A protective hood in accordance with claim 22, wherein the internal tab of the nose cup link is connected to the nose cup only at the side wall.

32. A protective hood in accordance with claim 22, wherein the hood body extends between the internal and external tabs of the nose cup link.

33. A protective hood in accordance with claim 22, wherein the nose cup comprises a connection ring, the internal tab of the nose cup link comprising a loop that is connected to the connection ring.

34. A protective hood in accordance with claim 33, wherein the connection ring comprises a D-ring.

35. A protective hood in accordance with claim 22, wherein the shared joint between the internal and external tabs of the nose cup link translates tension in the harness assembly to the nose cup instead of the hood body.

36. A protective hood in accordance with claim 22, wherein the shared joint between the internal and external tabs of the nose cup link permits limited movement of the hood body relative to the side wall of the nose cup.

* * * * *